US009231304B2

(12) United States Patent
Oh et al.

(10) Patent No.: US 9,231,304 B2
(45) Date of Patent: Jan. 5, 2016

(54) WIDEBAND LOOP ANTENNA AND AN ELECTRONIC DEVICE INCLUDING THE SAME

(71) Applicant: Nvidia Corporation, Santa Clara, CA (US)

(72) Inventors: Sung Hoon Oh, Santa Clara, CA (US); Joselito Gavilan, Santa Clara, CA (US); Warren Lee, Santa Clara, CA (US)

(73) Assignee: NVIDIA CORPORATION, Santa Clara, CA (US)

( * ) Notice: Subject to any disclaimer, the term of this patent is extended or adjusted under 35 U.S.C. 154(b) by 222 days.

(21) Appl. No.: 14/160,036

(22) Filed: Jan. 21, 2014

(65) Prior Publication Data

US 2015/0207230 A1 Jul. 23, 2015

(51) Int. Cl.

| | |
|---|---|
| ***H01Q 1/24*** | (2006.01) |
| ***H01Q 7/00*** | (2006.01) |
| ***H01Q 9/04*** | (2006.01) |

(52) U.S. Cl.

CPC ..... *H01Q 7/00* (2013.01); *H01Q 1/243* (2013.01); *H01Q 9/0407* (2013.01)

(58) Field of Classification Search

CPC ..... H01Q 1/24; H01Q 13/10
USPC ..... 343/702, 722, 700 MS
See application file for complete search history.

(56) References Cited

U.S. PATENT DOCUMENTS

| | | | |
|---|---|---|---|
| 4,125,810 | A | 11/1978 | Pavio |
| 5,861,854 | A | 1/1999 | Kawahata et al. |
| 6,229,487 | B1 | 5/2001 | Sadler et al. |
| 6,476,769 | B1 | 11/2002 | Lehtola |
| 6,911,940 | B2 | 6/2005 | Poilasne et al. |
| 7,091,908 | B2 | 8/2006 | Fabrega-Sanchez |
| 7,362,286 | B2 | 4/2008 | Fang |
| 7,551,142 | B1 | 6/2009 | Zhang et al. |
| 7,696,928 | B2 | 4/2010 | Rowell |

(Continued)

FOREIGN PATENT DOCUMENTS

| | | | |
|---|---|---|---|
| CN | 101106211 | A | 1/2008 |
| CN | 101442151 | A | 5/2009 |

(Continued)

OTHER PUBLICATIONS

Oh, Sung Hoon, et al., U.S. Appl. No. 14/159,880, filed Jan. 21, 2014, entitled "Wideband Antenna and an Electronic Device Including the Same".

(Continued)

*Primary Examiner* — Huedung Mancuso

(57) ABSTRACT

Provided is an antenna. In one aspect, the antenna includes a feed element having a first feed element end and a second feed element end, the first feed element end configured to electrically connect to a positive terminal of a transmission line. The antenna, in this aspect, further includes a loop antenna element having a first loop antenna element end and a second loop antenna element end, wherein the first loop antenna element end is coupled to the second feed element end and the second loop antenna element end is configured to electrically connect to a negative terminal of the transmission line. The antenna, of this aspect, further includes a monopole antenna element having a first monopole antenna element end and a second monopole antenna element end, wherein the first monopole antenna element end is coupled to the second feed element end.

20 Claims, 3 Drawing Sheets

(56) References Cited

U.S. PATENT DOCUMENTS

| | | | | |
|---|---|---|---|---|
| 8,421,682 | B2 | 4/2013 | Nielsen et al. | |
| 8,648,752 | B2 | 2/2014 | Ramachandran et al. | |
| 8,665,164 | B2 | 3/2014 | Hill et al. | |
| 8,698,673 | B2 | 4/2014 | Wong et al. | |
| 8,766,859 | B2 * | 7/2014 | Merz | H01Q 1/243 343/702 |
| 8,779,999 | B2 | 7/2014 | Gummalla | |
| 8,836,587 | B2 * | 9/2014 | Darnell | H01Q 1/243 343/700 MS |
| 8,957,827 | B1 | 2/2015 | Lee et al. | |
| 2002/0146909 | A1 | 10/2002 | Yang et al. | |
| 2004/0252061 | A1 | 12/2004 | Vance | |
| 2006/0082506 | A1 | 4/2006 | Fang | |
| 2006/0139211 | A1 | 6/2006 | Vance et al. | |
| 2006/0208950 | A1 * | 9/2006 | Tago | H01Q 1/243 343/702 |
| 2007/0182658 | A1 | 8/2007 | Ozden | |
| 2008/0106478 | A1 * | 5/2008 | Hill | H01Q 1/243 343/702 |
| 2008/0231521 | A1 * | 9/2008 | Anguera Pros | H01Q 1/243 343/702 |
| 2010/0033380 | A1 | 2/2010 | Pascolini et al. | |
| 2010/0271264 | A1 | 10/2010 | Li et al. | |
| 2010/0321255 | A1 | 12/2010 | Kough et al. | |
| 2011/0001675 | A1 | 1/2011 | Lee | |
| 2011/0260938 | A1 | 10/2011 | Xie | |
| 2012/0046002 | A1 | 2/2012 | Hill et al. | |
| 2012/0154223 | A1 | 6/2012 | Oh et al. | |
| 2012/0173754 | A1 | 7/2012 | Dalrymple et al. | |
| 2012/0214412 | A1 | 8/2012 | Schlub et al. | |
| 2012/0249393 | A1 | 10/2012 | Hotta et al. | |
| 2012/0299785 | A1 | 11/2012 | Bevelacqua | |
| 2013/0050057 | A1 | 2/2013 | Hayashi et al. | |
| 2013/0135156 | A1 | 5/2013 | Tsai et al. | |
| 2014/0118194 | A1 | 5/2014 | Gavilan et al. | |
| 2014/0118204 | A1 | 5/2014 | Gavilan et al. | |
| 2014/0141731 | A1 | 5/2014 | Abudul-Gaffoor et al. | |
| 2014/0159989 | A1 | 6/2014 | Malek et al. | |
| 2014/0232612 | A1 | 8/2014 | Jenwatanavet | |
| 2015/0022401 | A1 | 1/2015 | Gavilan et al. | |
| 2015/0022402 | A1 | 1/2015 | Gavilan et al. | |

FOREIGN PATENT DOCUMENTS

| | | | |
|---|---|---|---|
| CN | 201927704 | A | 8/2011 |
| DE | 69723366 | T2 | 4/2004 |
| DE | 102013017512 | A1 | 5/2014 |
| EP | 2405533 | A1 | 1/2012 |
| TW | 201101591 | A | 1/2011 |

OTHER PUBLICATIONS

Oh, Sung Hoon, et al., U.S. Appl. No. 14/160,231, filed Jan. 21, 2014, entitled "Co-Located Antennas and an Electronic Device Including the Same".

Oh, Sung Hoon, et al., U.S. Appl. No. 14/160,277, filed Jan. 21, 2014, entitled "Single Element Dual-Feed Antennas and an Electronic Device Including the Same".

* cited by examiner

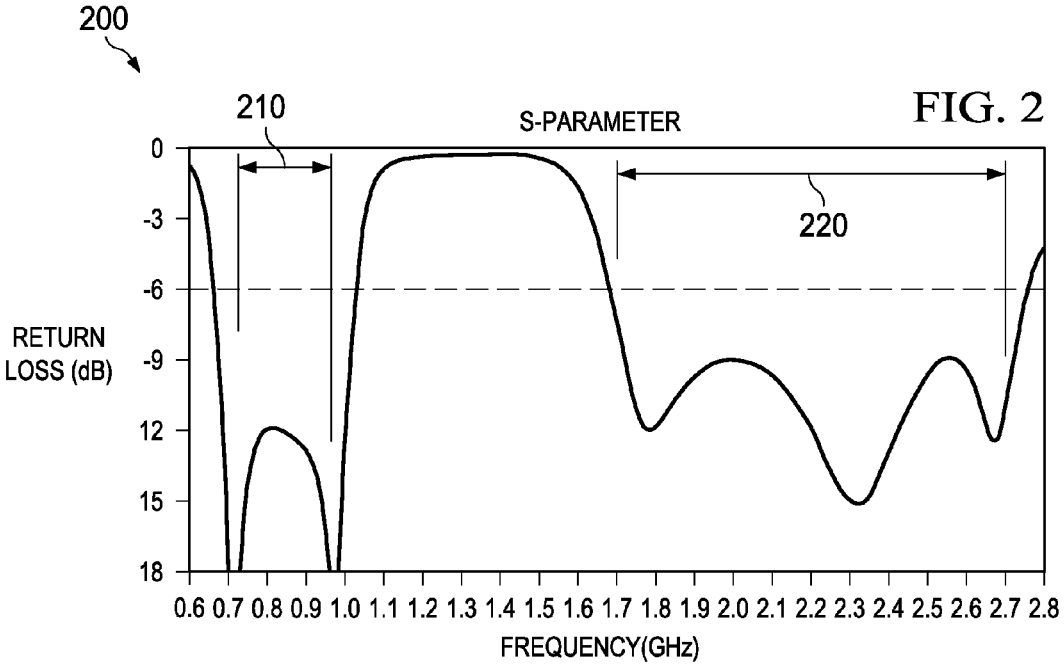
FIG. 2
FIG. 4
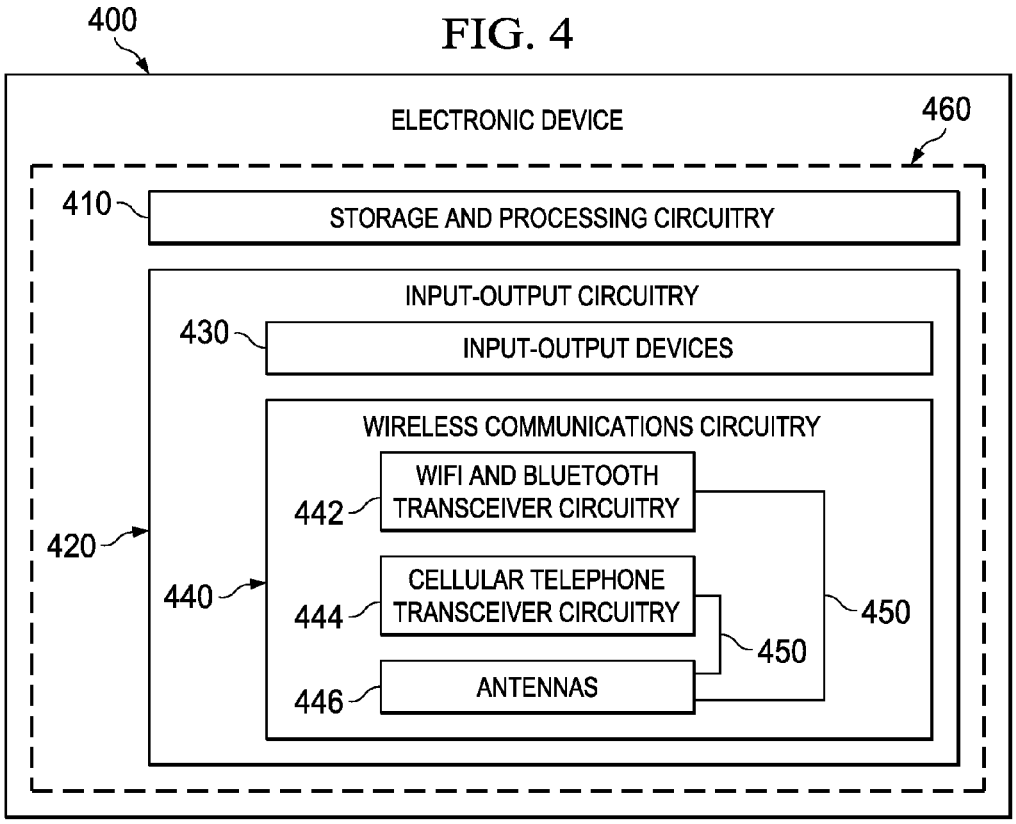

WIDEBAND LOOP ANTENNA AND AN ELECTRONIC DEVICE INCLUDING THE SAME

This application is directed, in general, to antennas and, more specifically, to wideband loop antennas for handheld electronic devices.

BACKGROUND

Handheld electronic devices are becoming increasingly popular. Examples of handheld devices include handheld computers, cellular telephones, media players, and hybrid devices that include the functionality of multiple devices of this type, among others.

Due in part to their mobile nature, handheld electronic devices are often provided with wireless communications capabilities. Handheld electronic devices may use long-range wireless communications to communicate with wireless base stations. For example, cellular telephones may communicate using 2G Global System for Mobile Communication (commonly referred to as GSM) frequency bands at about 850 MHz, 900 MHz, 1800 MHz, and 1900 MHz, among possible others. Communication is also possible in the 3G Universal Mobile Telecommunication System (commonly referred to as UMTS, and more recently HSPA+) and 4G Long Term Evolution (commonly referred to as LTE) frequency bands which range from 700 MHz to 3800 MHz. Furthermore, communications can operate on channels with variable bandwidths of 1.4 MHz to 20 MHz for LTE, as opposed to the fixed bandwidths of GSM (0.2 MHz) and UMTS (5 MHz). Handheld electronic devices may also use short-range wireless communications links. For example, handheld electronic devices may communicate using the Wi-Fi® (IEEE 802.11) bands at about 2.4 GHz and 5 GHz, and the Bluetooth® band at about 2.4 GHz. Handheld devices with Global Positioning System (GPS) capabilities receive GPS signals at about 1575 MHz.

To satisfy consumer demand for small form factor wireless devices, manufacturers are continually striving to reduce the size of components that are used in these handheld electronic devices. For example, manufacturers have made attempts to miniaturize the antennas used in handheld electronic devices. Unfortunately, doing so within the confines of the wireless device package is challenging.

Accordingly, what is needed in the art is an antenna, and associated wireless handheld electronic device, that navigate the desires and problems associated with the foregoing.

SUMMARY

One aspect provides an antenna. The antenna, in this aspect, includes a feed element having a first feed element end and a second feed element end, the first feed element end configured to electrically connect to a positive terminal of a transmission line. The antenna, in this embodiment, further includes a loop antenna element having a first loop antenna element end and a second loop antenna element end, wherein the first loop antenna element end is coupled to the second feed element end and the second loop antenna element end is configured to electrically connect to a negative terminal of the transmission line. The antenna, of this embodiment, further includes a monopole antenna element having a first monopole antenna element end and a second monopole antenna element end, wherein the first monopole antenna element end is coupled to the second feed element end.

Another aspect provides an electronic device. The electronic device, in this aspect, includes storage and processing circuitry, input-output devices associated with the storage and processing circuitry, and wireless communications circuitry including an antenna. The antenna, in this aspect, includes: 1) a feed element having a first feed element end and a second feed element end, the first feed element end configured to electrically connect to a positive terminal of a transmission line, 2) a loop antenna element having a first loop antenna element end and a second loop antenna element end, wherein the first loop antenna element end is coupled to the second feed element end and the second loop antenna element end is configured to electrically connect to a negative terminal of the transmission line, and 3) a monopole antenna element having a first monopole antenna element end and a second monopole antenna element end, wherein the first monopole antenna element end is coupled to the second feed element end.

BRIEF DESCRIPTION

Reference is now made to the following descriptions taken in conjunction with the accompanying drawings, in which:

FIG. 2 illustrates an S-parameter plot for a wideband antenna in accordance with the present disclosure;

FIG. 4 illustrates a schematic diagram of electronic device in accordance with the disclosure.

DETAILED DESCRIPTION

The present disclosure is based, at least in part, on the recognition that wireless networks are constantly evolving to increase speed and improve data communication, and that the latest cellular network, called Long Term Evolution (LTE) or 4G, not only operates in different frequency bands amongst carriers, but also between different regions. As a result, mobile electronic devices, such as smart phones, tablets and laptops, will need to support multiple LTE bands in addition to the legacy 3G (UMTS) and 2G (GSM) bands.

Table 1, set forth below, lists the 2G, 3G and 4G frequency bands for AT&T and Verizon, as well as the commonly deployed frequency bands in EMEA and APAC.

TABLE 1

| Frequency Bands | | | | |
|---|---|---|---|---|
| Band | Frequency | AT&T | Verizon | EMEA/APAC |
| 17 | 704-746 | 4G | | |
| 13 | 746-787 | | 4G | |
| 5 | 824-894 | 2G/3G | 2G/3G | |
| 8 | 880-960 | | | 2G/3G |
| 4 | 1710-1755, 2110-2155 | 4G | | 4G |
| 3 | 1710-1880 | | | 2G/4G |
| 2 | 1850-1990 | 2G/3G | 2G/3G | |
| 1 | 1920-1980, 2110-2170 | | | 3G/4G |
| 7 | 2500-2690 | | | 4G |

The addition of these frequency bands creates a significant challenge for antenna designers, since the antennas will now need to cover additional bands in the same allocated volume.

With this recognition in mind, the present disclosure acknowledged, for the first time, that a wideband loop antenna capable of accommodating the aforementioned frequencies is achievable by having a loop antenna element and a monopole antenna element extend (e.g., split) from a single feed element. Specifically, in one embodiment, the loop antenna element and monopole antenna element extend from the single feed element in substantially opposite directions.

Figure 1:
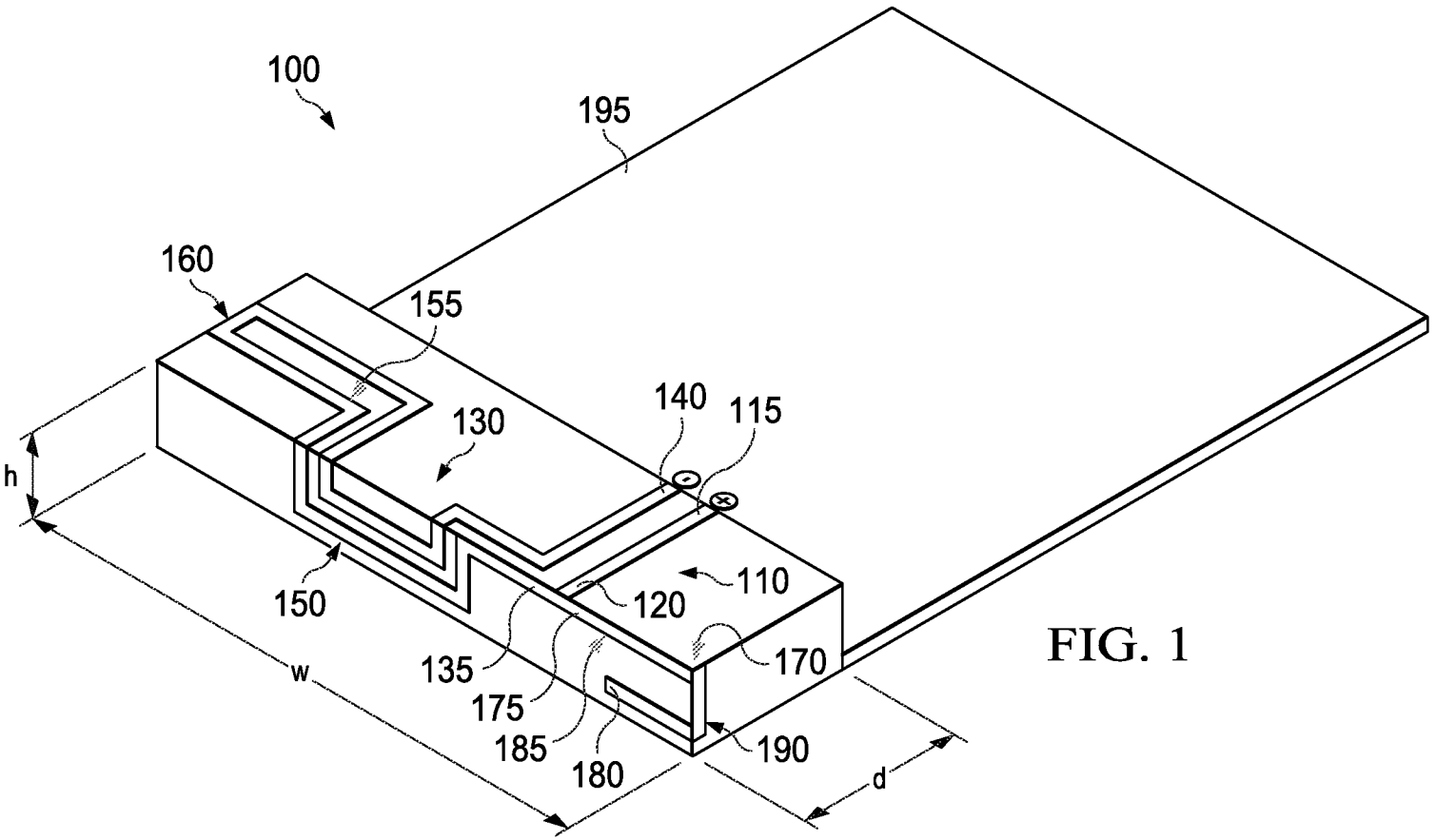
FIG. 1 illustrates an antenna manufactured and designed according to one embodiment of the disclosure.

Turning to FIG. 1, illustrated is an antenna 100 manufactured and designed according to one embodiment of the disclosure. The antenna 100, in the embodiment of FIG. 1, includes a feed element 110, including a first feed element end 115 and a second feed element end 120. In accordance with one embodiment of the present disclosure, the feed element 110 might directly connect to a positive terminal of a transmission line (not shown), such as a coaxial cable, microstrip, etc., to receive radio frequency signals from associated transceivers. The feed element 110 may additionally receive radio frequency signals from other antennas, and thus provide them to the associated transceivers. In the particular embodiment of FIG. 1, the first feed element end 115 is coupled to the positive terminal of the transmission line.

The antenna 100 illustrated in FIG. 1 further includes a loop antenna element 130 directly coupled to the feed element 110. In the particular embodiment of FIG. 1, the loop antenna element 130 includes a first loop antenna element end 135 and a second loop antenna element end 140. Further to the embodiment of FIG. 1, the first loop antenna element end 135 is coupled to the second feed element end 120. Additionally, the second loop antenna element end 140 is configured to (and in the embodiment of FIG. 1 actually does) electrically connect to a negative terminal of the transmission line. The second loop antenna element end 140, in accordance with one embodiment of the disclosure, may connect to or form a portion of the conductive chassis 195.

The loop antenna element 130, in accordance with one embodiment of the disclosure, may include different loop antenna sections. In the embodiment of FIG. 1, the loop antenna element 130 includes approximately fifteen different sections, including a first loop antenna section 150, a second loop antenna section 155 and a third loop antenna section 160 (hidden in the view of FIG. 1). In the particular embodiment of FIG. 1, a major plane of the first loop antenna section 150 is located substantially perpendicular to a major plane of the second loop antenna section 155. Similar to the embodiment of FIG. 1, a major plane of the third loop antenna section 160 is perpendicular to the major planes of the first and second loop antenna sections 150, 155. This configuration, in one embodiment, is achievable by routing the loop antenna element along different perpendicular edges of the chassis 195. The term "major plane", as used throughout this disclosure, refers to a plane created by the two largest dimensions of any given antenna section (e.g., height and width) as opposed to a plane created using the third smallest dimension of a given antenna section (e.g., the thickness).

The antenna 100 illustrated in FIG. 1 further includes a monopole antenna element 170. The monopole antenna element 170, in accordance with one embodiment, couples to the same feed element 110 as the loop antenna element 130. In the embodiment of FIG. 1, the monopole antenna element 170 includes a first monopole antenna element end 175 and a second monopole antenna element end 180. In this embodiment, it is the first monopole antenna element end 175 that couples to the second feed element end 120 of the feed element 110. In the particular embodiment of FIG. 1, the second monopole antenna element end 180 is free from a direction connection.

The monopole antenna element 170, similar to the loop antenna element 130, may have a number of different sections and remain within the purview of the disclosure. In the embodiment of FIG. 1, the monopole antenna element 170 has three different sections, including a first monopole antenna section 185 and a second monopole antenna section 190. Further to this embodiment, a major plane of the first monopole antenna section 185 is located substantially perpendicular to a major plane of the second monopole antenna section 190.

As those skilled in the art now appreciate, the cooperation between the loop antenna element 130 and the monopole antenna element 170, both which extend from the single feed element 110, greatly affects the ability of the antenna 100 to function as a single wideband antenna structure. For example, in the embodiment of FIG. 1, the loop antenna element 130 and monopole antenna element 170 each extend from the second feed element end 120 in opposite directions. Accordingly, in this embodiment, they take an initial shape of a T.

Similarly, the lengths of the loop antenna element 130 and the monopole antenna element 170, and furthermore their lengths in relation to one another, are important to the operation of the antenna 100. In one embodiment, the loop antenna element 130 has a length ($L_L$) defined by the first loop antenna element end 135 and the second loop antenna element end 140. Further to this embodiment, the monopole antenna element 170 has a length ($L_M$) defined by the first monopole antenna element end 175 and the second monopole antenna element end 180. In accordance with one particular embodiment wherein the antenna 100 operates amongst a very wide range of frequencies, the length ($L_M$) is less than about 30 percent of the length ($L_L$). In yet another embodiment, the length ($L_M$) is less than about 20 percent of the length ($L_L$).

An antenna, such as the antenna 100 illustrated in FIG. 1, or many other antennas manufactured in accordance with the disclosure, may be configured to fit within existing antenna volumes. For instance, in one embodiment, the antenna 100 fits within an existing volume defined by a width (w), a height (h) and a depth (d). Such a volume, in many embodiments, forms the shape of a cube, as opposed to a more random volume. In accordance with one embodiment, the feed element 110, loop antenna element 130 and monopole antenna element 170 are positionable to operate within a volume of less than about 4 $cm^3$. In yet another embodiment, the feed element 110, loop antenna element 130 and monopole antenna element 170 are positionable to operate within a volume of less than about 2 $cm^3$.

By orienting the loop antenna element and monopole antenna element, as described in the embodiments above, an extremely low quality factor (low-Q) multi-bandwidth antenna resonating structure, having wide bandwidths for both the low and high bands, is achievable. For example, such an antenna is capable of a lower band bandwidth ranging from about 704-960 MHz and a higher band bandwidth ranging from about 1700-2700 MHz, and more specifically 1710-2170 MHz.

FIG. 2 illustrates an S-parameter plot 200 for a wideband loop antenna in accordance with the present disclosure. The S-parameter plot 200 might, in one embodiment, be representative of the wideband loop antenna 100 of FIG. 1. Specifically, plot 200 illustrates the frequencies attainable in the lower band bandwidth 210, as well as the frequencies attainable in the higher band bandwidth 220. Additionally, for these given ranges, the return loss values for the desirable frequencies are well below −6, which is outstanding for a wideband antenna. As is clear from the plot 200, the return loss values for the 704-960 MHz lower band and the 1700-2700 MHz higher band are actually less than about −9.

Figure 3:
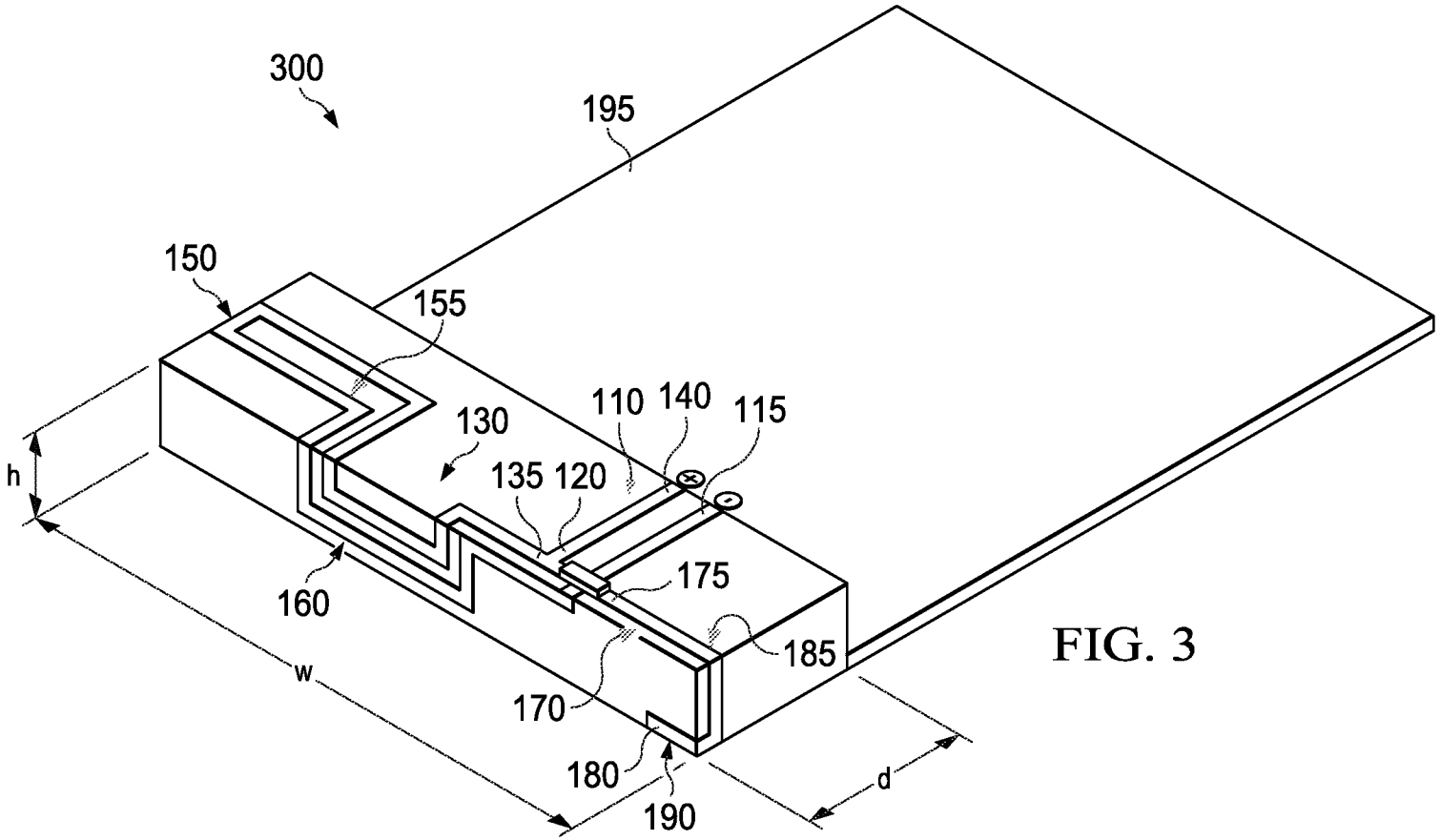
FIG. 3 illustrates alternative aspects of a representative embodiment of an antenna in accordance with embodiments of the disclosure.

FIG. 3 illustrates alternative aspects of a representative embodiment of an antenna 300 in accordance with embodiments of the disclosure. Where used, like reference numerals indicate similar features to the antenna 100 of FIG. 1. The antenna 300 of FIG. 3 differs, for the most part, from the antenna 100 of FIG. 1, in that the feed element 110 of FIG. 3 is inside (e.g., as it relates to a central point of the chassis 195, in this embodiment the width (w)) the second loop antenna element end 140 of the loop antenna element 130. In contrast, the second loop antenna element end 140 of the loop antenna element 130 of FIG. 1 is inside the feed element 110. Moreover, in the embodiment of FIG. 3, the monopole antenna element 170 bridges the second loop antenna element end 140, for example as a result of the inside nature of the feed element 110. FIG. 3 illustrates but another embodiment of an antenna manufactured in accordance with the disclosure.

FIG. 4 shows a schematic diagram of electronic device 400 manufactured in accordance with the disclosure. Electronic device 400 may be a portable device such as a mobile telephone, a mobile telephone with media player capabilities, a handheld computer, a remote control, a game player, a global positioning system (GPS) device, a laptop computer, a tablet computer, an ultraportable computer, a combination of such devices, or any other suitable portable electronic device.

As shown in FIG. 4, electronic device 400 may include storage and processing circuitry 410. Storage and processing circuitry 410 may include one or more different types of storage such as hard disk drive storage, nonvolatile memory (e.g., flash memory or other electrically-programmable-read-only memory), volatile memory (e.g., static or dynamic random-access-memory), etc. Processing circuitry in the storage and processing circuitry 410 may be used to control the operation of device 400. The processing circuitry may be based on a processor such as a microprocessor or other suitable integrated circuits. With one suitable arrangement, storage and processing circuitry 410 may be used to run software on device 400, such as internet browsing applications, voice-over-internet-protocol (VOIP) telephone call applications, email applications, media playback applications, operating system functions, etc. Storage and processing circuitry 410 may be used in implementing suitable communications protocols.

Communications protocols that may be implemented using storage and processing circuitry 410 include, without limitation, internet protocols, wireless local area network protocols (e.g., IEEE 802.11 protocols—sometimes referred to as WiFi®), protocols for other short-range wireless communications links such as the Bluetooth® protocol, protocols for handling 3G communications services (e.g., using wide band code division multiple access techniques), 2G cellular telephone communications protocols, etc. Storage and processing circuitry 410 may implement protocols to communicate using 2G cellular telephone bands at 850 MHz, 900 MHz, 1800 MHz, and 1900 MHz (e.g., the main Global System for Mobile Communications or GSM cellular telephone bands) and may implement protocols for handling 3G and 4G communications services.

Input-output device circuitry 420 may be used to allow data to be supplied to device 400 and to allow data to be provided from device 400 to external devices. Input-output devices 430 such as touch screens and other user input interfaces are examples of input-output circuitry 420. Input-output devices 430 may also include user input-output devices such as buttons, joysticks, click wheels, scrolling wheels, touch pads, key pads, keyboards, microphones, cameras, etc. A user can control the operation of device 400 by supplying commands through such user input devices. Display and audio devices may be included in devices 430 such as liquid-crystal display (LCD) screens, light-emitting diodes (LEDs), organic light-emitting diodes (OLEDs), and other components that present visual information and status data. Display and audio components in input-output devices 430 may also include audio equipment such as speakers and other devices for creating sound. If desired, input-output devices 430 may contain audio-video interface equipment such as jacks and other connectors for external headphones and monitors.

Wireless communications circuitry 440 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications). Wireless communications circuitry 440 may include radio-frequency transceiver circuits for handling multiple radio-frequency communications bands. For example, circuitry 440 may include transceiver circuitry 442 that handles 2.4 GHz and 5 GHz bands for WiFi® (IEEE 802.11) communications and the 2.4 GHz Bluetooth® communications band. Circuitry 440 may also include cellular telephone transceiver circuitry 444 for handling wireless communications in cellular telephone bands such as the GSM bands at 850 MHz, 900 MHz, 1800 MHz, and 1900 MHz, as well as the UMTS, HSPA+ and LTE bands (as examples). Wireless communications circuitry 440 can include circuitry for other short-range and long-range wireless links if desired. For example, wireless communications circuitry 440 may include global positioning system (GPS) receiver equipment, wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 440 may include antennas 446. Device 400 may be provided with any suitable number of antennas. There may be, for example, one antenna, two antennas, three antennas, or more than three antennas, in device 400. For example, in one embodiment, the antennas 446 form at least a portion of an antenna, such as the antennas discussed above with regard to FIGS. 1-2, among others. In accordance with the disclosure, the antennas may handle communications over multiple communications bands. Different types of antennas may be used for different bands and combinations of bands. For example, it may be desirable to form a multi-band antenna for forming a local wireless link antenna, a multi-band antenna for handling cellular telephone communications bands, and a single band antenna for forming a global positioning system antenna (as examples).

Paths 450, such as transmission line paths, may be used to convey radio-frequency signals between transceivers 442 and 444, and antennas 446. Radio-frequency transceivers such as radio-frequency transceivers 442 and 444 may be implemented using one or more integrated circuits and associated components (e.g., power amplifiers, switching circuits, matching network components such as discrete inductors and capacitors, and integrated circuit filter networks, etc.). These devices may be mounted on any suitable mounting structures. With one suitable arrangement, transceiver integrated circuits may be mounted on a printed circuit board. Paths 450 may be used to interconnect the transceiver integrated circuits and other components on the printed circuit board with antenna structures in device 400. Paths 450 may include any suitable conductive pathways over which radio-frequency signals may be conveyed including transmission line path structures such as coaxial cables, microstrip transmission lines, etc.

The device 400 of FIG. 4 further includes a chassis 460. The chassis 460 may be used for mounting/supporting electronic components such as a battery, printed circuit boards containing integrated circuits and other electrical devices, etc. For example, in one embodiment, the chassis 460 positions and supports the storage and processing circuitry 410, and the input-output circuitry 420, including the input-output devices 430 and the wireless communications circuitry 440 (e.g., including the WIFI and Bluetooth transceiver circuitry 442, the cellular telephone circuitry 444, and the antennas 446.

The chassis 460, in one embodiment, is a metal chassis. For example, the chassis 460 may be made of various different metals, such as aluminum. Chassis 460 may be machined or cast out of a single piece of material, such as aluminum. Other methods, however, may additionally be used to form the chassis 460. In certain embodiments, the chassis 460 will couple to at least a portion of the antennas 446.

Those skilled in the art to which this application relates will appreciate that other and further additions, deletions, substitutions and modifications may be made to the described embodiments.

What is claimed is:

1. An antenna, comprising:

a feed element having a first feed element end and a second feed element end, the first feed element end configured to electrically connect to a positive terminal of a transmission line;

a loop antenna element having a first loop antenna element end and a second loop antenna element end, wherein the first loop antenna element end is coupled to the second feed element end and the second loop antenna element end is configured to electrically connect to a negative terminal of the transmission line; and a monopole antenna element having a first monopole antenna element end and a second monopole antenna element end, wherein the first monopole antenna element end is coupled to the second feed element end.

2. The antenna of claim 1 wherein the second monopole antenna element end is free from a direct connection.

3. The antenna of claim 1 wherein the loop antenna element extends from the second feed element end in a first direction, and the monopole antenna element extends from the second feed element end in a second opposite direction.

4. The antenna of claim 1 wherein the loop antenna element has a first loop antenna section and a second loop antenna section, and further wherein a major plane of the first loop antenna section is located substantially perpendicular to a major plane of the second loop antenna section.

5. The antenna of claim 4 wherein the loop antenna element has a third loop antenna section, and further wherein a major plane of the third loop antenna section is perpendicular to the major planes of the first and second loop antenna sections.

6. The antenna of claim 1 wherein the monopole antenna has a first monopole antenna section and a second monopole antenna section, and further wherein a major plane of the first monopole antenna section is located substantially perpendicular to a major plane of the second monopole antenna section.

7. The antenna of claim 1 wherein the second loop antenna element end electrically connects to the negative terminal of the transmission line.

8. The antenna of claim 1 wherein the loop antenna element has a length ($L_L$) and the monopole antenna element has a length ($L_M$), and further wherein the length ($L_M$) is less than about 30 percent of the length ($L_L$).

9. The antenna of claim 8 wherein the length ($L_M$) is less than about 20 percent of the length ($L_L$).

10. The antenna of claim 1 wherein the feed element, loop antenna element and monopole antenna element are positionable to operate within a volume of less than about 2 $cm^3$.

11. An electronic device, comprising:

storage and processing circuitry;

input-output devices associated with the storage and processing circuitry; and wireless communications circuitry including an antenna, the antenna including;

a feed element having a first feed element end and a second feed element end, the first feed element end electrically connected to a positive terminal of a transmission line;

a loop antenna element having a first loop antenna element end and a second loop antenna element end, wherein the first loop antenna element end is coupled to the second feed element end and the second loop antenna element end is electrically connected to a negative terminal of the transmission line; and a monopole antenna element having a first monopole antenna element end and a second monopole antenna element end, wherein the first monopole antenna element end is coupled to the second feed element end.

12. The electronic device of claim 11 wherein the second monopole antenna element end is free from a direct connection.

13. The electronic device of claim 11 wherein the loop antenna element extends from the second feed element end in a first direction, and the monopole antenna element extends from the second feed element end in a second opposite direction.

14. The electronic device of claim 11 wherein the loop antenna element has a first loop antenna section and a second loop antenna section, and further wherein a major plane of the first loop antenna section is located substantially perpendicular to a major plane of the second loop antenna section.

15. The electronic device of claim 14 wherein the loop antenna element has a third loop antenna section, and further wherein a major plane of the third loop antenna section is perpendicular to the major planes of the first and second loop antenna sections.

16. The electronic device of claim 11 wherein the monopole antenna has a first monopole antenna section and a second monopole antenna section, and further wherein a major plane of the first monopole antenna section is located substantially perpendicular to a major plane of the second monopole antenna section.

17. The electronic device of claim 11 wherein the loop antenna element has a length ($L_L$) and the monopole antenna element has a length ($L_M$), and further wherein the length ($L_M$) is less than about 30 percent of the length ($L_L$).

18. The electronic device of claim 17 wherein the length ($L_M$) is less than about 20 percent of the length ($L_L$).

19. The electronic device of claim 11 wherein the feed element, loop antenna element and monopole antenna element are positionable to operate within a volume of less than about 2 $cm^3$.

20. The electronic device of claim 11, wherein the storage and processing circuitry, input-output devices, and wireless communications circuitry are positioned within a conductive chassis, and further wherein the second loop antenna element end is electrically connected to the conductive chassis.

* * * * *